US006852462B2

(12) United States Patent
Emoto et al.

(10) Patent No.: US 6,852,462 B2
(45) Date of Patent: Feb. 8, 2005

(54) TONER, METHOD OF FORMING THE TONER, AND IMAGE FORMING METHOD AND APPARATUS USING THE TONER

(75) Inventors: Shigeru Emoto, Numazu (JP); Tsunemi Sugiyama, Numazu (JP); Hiroshi Yamashita, Numazu (JP); Shinichiro Yagi, Numazu (JP); Masami Tomita, Numazu (JP); Hiroshi Yamada, Numazu (JP); Naohiro Watanabe, Suntou-gun (JP); Toshiki Nanya, Mishima (JP)

(73) Assignee: Ricoh Company Limited, Tokyo (JP)

( * ) Notice: Subject to any disclaimer, the term of this patent is extended or adjusted under 35 U.S.C. 154(b) by 47 days.

(21) Appl. No.: 10/286,816

(22) Filed: Nov. 4, 2002

(65) Prior Publication Data

US 2003/0152859 A1 Aug. 14, 2003

(30) Foreign Application Priority Data

Nov. 2, 2001 (JP) ..... 2001-338425
May 31, 2002 (JP) ..... 2002-160541

(51) Int. Cl.[7] ..... G03G 9/087
(52) U.S. Cl. ..... 430/109.4; 430/110.3; 430/110.4
(58) Field of Search ..... 430/109.4, 110.3, 430/110.4

(56) References Cited

U.S. PATENT DOCUMENTS 5,328,792 A 7/1994 Shigemori et al.
5,698,354 A * 12/1997 Ugai et al. ..... 430/45
5,747,210 A 5/1998 Emoto et al.
6,360,068 B1 3/2002 Kinoshita et al.
6,363,229 B1 3/2002 Shiraishi et al.
6,395,443 B2 5/2002 Kuroda et al.
6,403,275 B1 6/2002 Kuramoto et al.
6,432,589 B1 8/2002 Uchinokura et al.
6,468,706 B2 10/2002 Matsuda et al.
2003/0113648 A1 * 6/2003 Tomita et al. ..... 430/109.4

FOREIGN PATENT DOCUMENTS

| | | |
|---|---|---|
| EP | 0 606 873 | 7/1994 |
| EP | 0 822 458 | 2/1998 |
| EP | 1 026 554 | 8/2000 |
| JP | 9-15903 | 1/1997 |
| JP | 11-133665 | 5/1999 |
| JP | 11-149180 | 6/1999 |
| JP | 2000-292981 | 10/2000 |

* cited by examiner

*Primary Examiner*—Mark A. Chapman
(74) *Attorney, Agent, or Firm*—Oblon, Spivak, McCelland, Maier & Neustadt, P.C.

(57) ABSTRACT

A toner comprising:

a binder resin which is at least a resin selected from the group consisting of modified polyester resins and unmodified polyester resins; and a colorant; the product toner having a volume-average particle diameter (Dv) to a number-average particle diameter (Dn) ratio (Dv/Dn) ranging from 1.00 to 1.30, and the toner having a shape factor SF-1 ranging from 140 to 200.

16 Claims, 1 Drawing Sheet

TONER, METHOD OF FORMING THE TONER, AND IMAGE FORMING METHOD AND APPARATUS USING THE TONER

BACKGROUND OF THE INVENTION

1. Field of the Invention

The present invention relates to a toner for use in a developer developing an electrostatic latent image in electrophotographies, electrostatic recording and electrostatic printing, and to a method of producing the toner and an image forming method and an apparatus using the toner.

In addition, the present invention relates more specifically to a toner for use in copiers, laser printers and plain paper facsimiles directly or indirectly using an electrophotographic developing method, and to a method of producing the toner and an image forming method and an apparatus using the toner.

2. Discussion of the Background

Due to a recent strong demand for a high-quality image, developments of an electrophotographic apparatus and a toner developer in compliance with the demand are accelerated. It is essential that the toner particles have a uniform diameter for the high-quality image. When the particle diameter distribution is sharp, individual toner particles uniformly work to remarkably improve reproducibility of a micro dot image.

However, toner particles having a small and uniform diameter has less cleanability. In particular, it is impossible to stably clean the toner particles having a small and uniform diameter with a cleaning blade. One of methods of improving the cleanability suggested is to change the toner particles from spheric particles to irregular-shaped particles. The irregular-shaped toner particles have less fluidity and the cleaning blade can easily catch the toner particles. However, toner particles being too irregular-shaped do not stably work in developing and have less micro dot reproducibility.

As mentioned above, the irregular-shaped toner particles have improved cleanability, but have deteriorated fixability. Namely, the irregular-shaped toner particles has less density in a toner layer on a transfer material before fixed and a conduction in the toner layer is deteriorated when fixed, resulting in deterioration of the low-temperature fixability. In particular, when a fixing pressure is smaller than usual, the conduction is further deteriorated.

Japanese Laid-Open Patent Publication No. 11-133665 discloses a toner including polyester having a Wadell practical sphericity of from 0.90 to 1.00. However, the toner is substantially spheric and does not solve the above-mentioned cleanability problem.

A toner polymerization method includes an emulsifying polymerization method and a dissolving suspension method, which easily produce the irregular-shaped toner particles other than a suspension polymerization method. However, it is also difficult to completely remove the styrene monomer, an emulsifier and a dispersant in the emulsifying polymerization method, which is becoming a more serious problem recently when an environmental protection is particularly emphasized. In addition, a silica included in the toner as a fluidizer does not strongly adhere to a concave portion thereof and moves thereto, which often causes problems such as photoreceptor contamination and adherence to a fixing roller due to a release of the silica when the developer is used for a long time. In the dissolving suspension method, there is an advantage of using a polyester resin capable of fixing at a low temperature, but productivity deteriorates because a high molecular weight material is controlled to increase releasability in an oilless fixation and a solvent has a high viscosity as the high molecular weight material is included in a process of dissolving or dispersing a resin or a colorant in the solvent. These problems are not solved yet. Particularly, in the dissolving suspension method, Japanese Laid-Open Patent Publication No. 9-15903 discloses a toner having a shape of both sphere and concavity and convexity to improve the cleanability, but the amorphous toner without uniformity has low chargeability and a design of a high molecular weight material is not completed yet to obtain basic durability and releasability, and therefore quality of the toner is still unsatisfactory.

Because of these reasons, a need exists for a toner producing high quality images having good reproducibility of a micro dot image.

SUMMARY OF THE INVENTION

Accordingly, an object of the present invention is to provide a toner producing high quality images having good reproducibility of a micro dot image, having highly reliable cleanability and good low-temperature fixability.

Another object of the present invention is to provide a toner producing high-quality images, having good transferability and less residual toner after transfer.

Yet another object of the present invention is to provide an oilless dry toner having both good chargeability and low-temperature fixability.

Further, another object of the present invention is to provide a new toner consuming less electric power and having both high transferability and a high OHP transmittance required for a full-color image.

Briefly these objects and other objects of the present invention as hereinafter will become more readily apparent can be attained by a toner including at least a binder resin and 20 a colorant, wherein the binder resin includes a modified and/or an unmodified polyester resin, a ratio (Dv/Dn) of a volume-average particle diameter (Dv) of the toner to a number-average particle diameter (Dn) thereof is from 1.00 to 1.30 and the toner has a shape factor SF-1 of from 140 to 200.

These and other objects, features and advantages of the present invention will become apparent upon consideration of the following description of the preferred embodiments of the present invention taken in conjunction with the accompanying drawing.

BRIEF DESCRIPTION OF THE DRAWINGS

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE INVENTION

Figure 1:
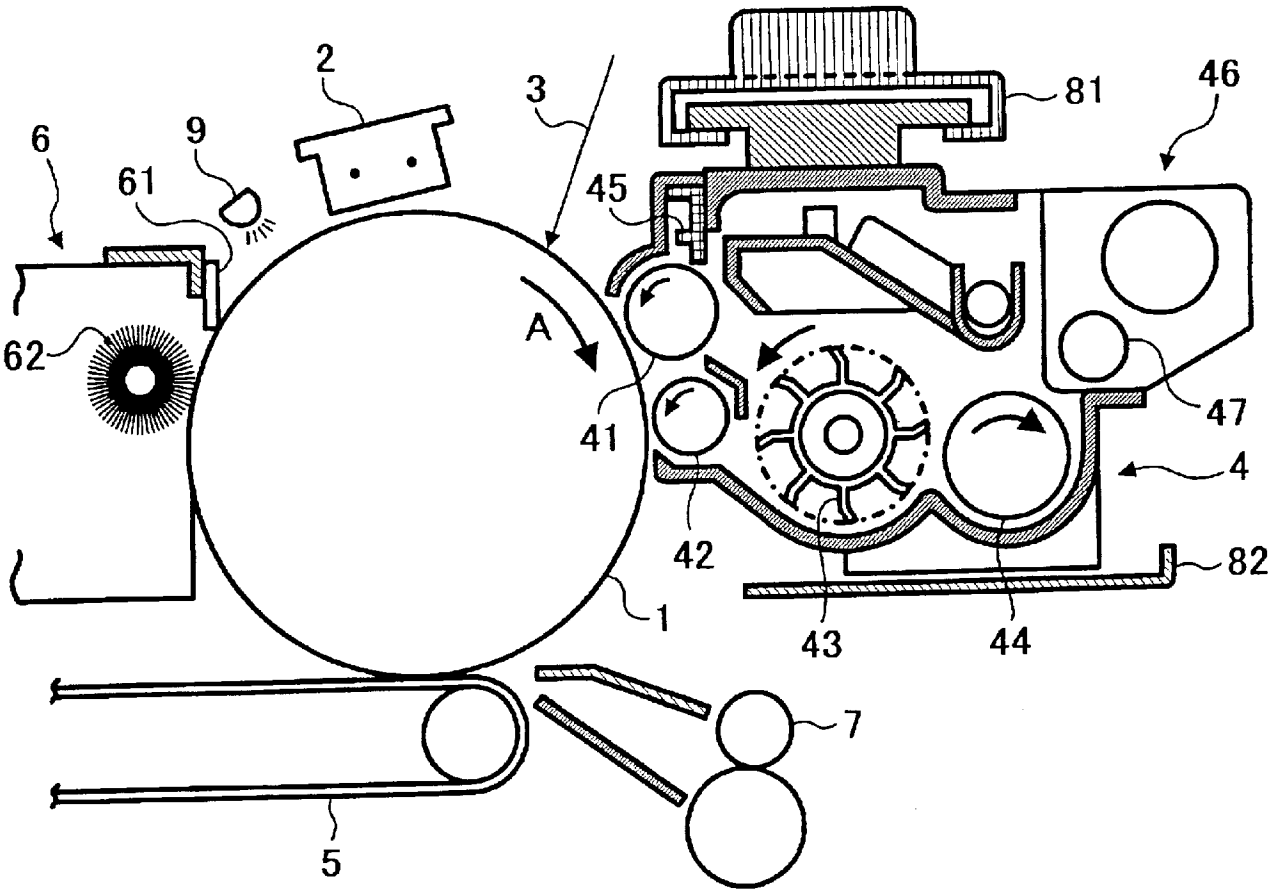
FIG. 1 is a schematic view illustrating an embodiment of the image forming apparatus of the present invention.

Generally, the present invention provides a toner producing high quality images having good reproducibility of a micro dot image, having highly reliable cleanability and good low-temperature fixability.

The toner of the present invention has a ratio (Dv/Dn) between a volume-average particle diameter (Dv) and a number-average particle diameter (Dn) of from 1.00 to 1.30, which produces high resolution and quality images. Further, in a two-component developer, even after the toner is consumed and supplied for a long time, the toner particle diameter has less variation. In addition, even after being agitated in an image developer for a long time, the toner has goad stable developability. When (Dv/Dn) is greater than 1.30, a variation of the individual toner particle diameter is large and the toner particles do not uniformly work, resulting in deterioration of reproducibility of a micro dot image. Dv/Dn is more preferably from 1.00 to 1.20 for better images.

The toner of the present invention preferably has a volume-average particle diameter (Dv) of from 3.0 to 7.0 μm.

Generally, the less the particle diameter of the toner, the more advantageous to produce high resolution and quality images. However, it is disadvantageous for transferability and cleanability. When the Dv is less than the above-mentioned range, the toner in a two-component developer adheres to a surface of a carrier due to a long agitation in an image developer, resulting in deterioration of chargeability of the carrier. The toner in a one-component developer tends to cause filming over a developing roller and adhere to a member such as a blade.

In particular, when the toner has greater than 10 number of the particles having a diameter not greater than 3 μm, the toner adheres to the carrier, resulting in deterioration of chargeability thereof.

When the Dv is greater than the above-mentioned range, the Dv tends to vary much and it is difficult to produce high resolution and quality images. In addition, when Dv/Dn is greater than 1.20, a similar problem occurs.

As mentioned above, since the toner having a small and uniform particle diameter has less cleanability, the toner preferably has a shape factor SF-1 of from 140 to 200.

First, a relationship between a shape of a toner and transferability thereof will be explained. In a full-color copier developing and transferring multi-color toners, an amount of the color toners on a photoreceptor is larger than that of a mono-color black toner and it is difficult to improve the transferability of the color toner when using only a conventional amorphous toner. Further, when the conventional amorphous toner is used, due to a friction between a photoreceptor and a cleaning member, an intermediate transferor and the cleaning member and/or the photoreceptor and the intermediate transferor, the toner adherence and filming tend to occur on surfaces of the photoreceptor and intermediate transferor, resulting in deterioration of the transferability. When a full-color image is produced, it is difficult to uniformly transfer 4 color toner images, color irregularity and balance problems tend to occur and it is not easy to stably produce high-quality full-color images.

In terms of a balance between the blade cleaning and transferability, the toner preferably has a shape factor SF- of from 140 to 200, and more preferably from 150 to 180. Since the cleaning and transferability are largely affected by a material of the blade and a way of contacting the blade, and transferability differs according to a process condition, the toner can be designed according to the process within a range of the above-mentioned SF-1. However, when SF-1 is less than 140, the cleanability by the blade is deteriorated. When SF-1 is greater than 200, the above-mentioned deterioration of the transferability occurs. This is because the irregular-shaped toner does not smoothly transports (form a photoreceptor to a transfer paper, from a surface of a photoreceptor to an intermediate transferor and from a first intermediate transferor to a second intermediate transferor, etc.) when transferred, and because individual toner particles irregularly work and do not have uniform transferability. Besides, charge instability and fragility of the particles occur. Further, the toner in the developer is pulverized, resulting in deterioration of durability of the developer.

The toner preferably has a shape of spindle in a range of the shape factor SF-1 of from 140 to 200. The spindle shape has good transferability next to a spheric shape because of having less concavity and convexity on a surface thereof. A spindle-shaped toner also has good cleanability having a conflicting relation against the transferability, and it can be said that the spindle shape is a very well-balanced shape.

A pulverized toner has an amorphous shape (not a specific, uniform or spheric shape) and a shape factor SF-1 greater than 140. However, the pulverized toner is produced by an inefficient method to make Dv/Dn not greater than 1.30 because of usually having a broad particle diameter distribution. Polymerization methods such as suspension polymerization methods and emulsifying polymerization methods have difficulty in producing a toner including a polyester resin. Namely, a toner having a lower-temperature fixability cannot be formed by the methods.

Japanese Laid-Open Patent Publications Nos. 11-149180 and 2000-292981 disclose a dry toner and a method of producing the toner including a binder formed from an elongation and/or a crosslinking reaction of a prepolymer including an isocyanate group, and a colorant, wherein the dry toner is formed of particles formed from an elongation and/or a crosslinking reaction of the prepolymer (A) by amines (B) in an aqueous medium. However, since the toner does not have a shape of the toner in the present invention, the toner does not have both the transferability and cleanability.

In the present invention, in a method of forming a toner using the above-mentioned reaction between the prepolymer (A) and the amines (B), a spindle-shaped toner having less concavity and convexity on a surface thereof is obtainable by controlling process conditions of evaporating a solvent from a toner liquid after the reaction. Specifically, a spindle-shaped toner having a shape factor SF-1 of from 140 to 200 and a SF-2 of from 100 to 130 can easily be obtained. The conventional suspension polymerization methods and emulsifying polymerization methods having a different solvent removal process from that of the present invention, have difficulty in controlling the shape.

Hereinafter, methods of measuring aspects of the toner of the present will be explained.

In the present invention, SF-1 and SF-2 representing shape factors of the toner are known factors. For example, SF-1 can be obtained by the following method:

randomly sampling 100 toner images enlarged 500 times as large as the original images using FE-SEM (S-800) from Hitachi, Ltd.; and introducing the image information to an image analyzer, e.g., Luzex III from Nicolet through an interface to analyze the information.

An average particle diameter and a particle diameter distribution of the toner are measured by a Coulter counter method. A Coulter counter TA-II a Coulter Multisizer II are used to measure the particle diameter distribution of a toner. In the present invention, an Interface producing a number distribution and a volume distribution from Nikkaki Bios Co., Ltd. and a personal computer PC9801 from NEC Corp. are connected with the Coulter Multisizer II to measure the average particle diameter and particle diameter distribution.

The measurement method is as follows:

from 0.1 to 5 ml of a detergent, preferably alkyl benzene sulfonate is included as a dispersant in an electrolyte having a volume of from 100 to 150 ml (the electrolyte is an aqueous solution having 1% NaCl using a first class natrium chloride, e.g., ISOTON-II from Beckman Coulter, Inc. can be used);

2 to 20 mg of a sample toner is included in the electrolyte and the toner is dispersed by an ultrasonic dispersant for about from 1 to 3 min; and the above-mentioned measurer measures a volume and number 25 of the toner particles to compute the volume and number distribution using an aperture of 100 μmg.

13 channels, i.e., 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm, are used, and the toner particles having a particle diameter of from 2.00 to less than 40.30 μm are to be measured. Dv and Dn of the present invention are determined from the volume distribution and number distribution of the toner.

In order to improve the hot offset resistance, various methods such as a control of a molecular weight distribution of a binder resin have been investigated. So as to obtain a toner having low fixability and hot offset resistance which are conflicting properties each other, a binder resin having a wide molecular weight distribution or a method of mixing a resin having a high molecular weight of from a half million to a multimillion and at least 2 molecular weight peaks and a resin having a low molecular weight of from a few thousand to ten thousands and at least 2 molecular weight peaks to separate a function of each resin is used. A high molecular weight resin having a crosslinking structure or being a gel is effective for the hot offset resistance. However, it is not preferable for a full-color toner requiring glossiness and transparency to introduce a large amount of the high molecular weight resin. In the toner of the present invention, since polyester can be elongated and polymerized by the above-mentioned urea bond, transparency and glossiness of the toner are satisfactory and hot offset resistance thereof is also satisfactory by including a content of 1% by weight of a high molecular weight component which is effective for the hot offset resistance.

A molecular weight distribution of a binder (resin) in the toner is measured by the following method:

after about 1 g of the toner is put in a conical flask, 10 to 20 g of tetrahydrofuran (THF) is included therein to prepare a THF liquid solution having a binder concentration of from 5 to 10%. A column is stabilized in a heat chamber having a temperature of 40° C. and 20 μl of the above-mentioned THF sample liquid solution is injected therein while THF is flown therein at a speed of 1 ml/min as a solvent. Molecular weight of the sample is determined from a relationship between a log value of a working curve made by a monodisperse polystyrene standard sample and a retention time. As the monodisperse polystyrene standard sample, samples having a molecular weight of from $2.7\times10^2$ to $6.2\times10^6$ from Tosoh Corp. are used. A refractive index (RI) detector is used as a detector. As the column, TSKgel, G1000H, G2000H, G2500H, G3000H, G4000h, G5000H, G6000H, G7000H and GMH are used in combination.

THF soluble resin preferably has a main peak molecular weight of from 2,500 to 10,000 and more preferably from 2,000 to 8,000. When a content of the THF soluble resin having a molecular weight less than 2,500 is increased, heat resistance of the resultant toner deteriorates. When a content of the THF soluble resin having a molecular weight greater than 10,000 is increased, low temperature fixability of the resultant toner simply deteriorates. However, a balance control of the content can prevent the deterioration. A content of the THF soluble resin having a molecular weight greater than 10,000 is preferably from 1 to 10% by weight, and more preferably from 3 to 6% by weight, although depending on the toner material. When less than 1% by weight, hot offset resistance is insufficient. When greater than 10%, glossiness and transparency deteriorate. A content of the THF soluble resin having a molecular weight of from 2,500 to 10,000 is preferably from 0.1 to 5.0% by weight.

The THF soluble resin preferably has a number-average molecular weight (Mn) of from 2,000 to 15,000, and weight-average molecular weight (Mw)/Mn is preferably not greater than 5. When greater than 5, glossiness deteriorates. In addition, a polyester resin including a THF insoluble component of from 1 to 25% by weight improves the hot offset resistance.

The THF insoluble component in a color toner has an effect on the hot offset resistance, but is definitely disadvantageous for the glossiness and transparency. However, the THF insoluble component of from 1 to 10% by weight improves releasability of the resultant toner.

A method of measuring the THF insoluble is as follows:

about 50 g of THF is included in about 1.0 g of a resin or a toner (A) and the mixture is left at 20° C. for 24 hrs;

the mixture is centrifugalized and filtered using a filter paper 5C specified in JIS standards (P3801)

the filtered liquid is dried by a vacuum dryer to measure an amount of the residue (B) which is a THF soluble component.

THF insoluble component (%) is determined by the following formula:

$$\text{THF insoluble component } (\%)=(A-B)/A\times100$$

In case of a toner, a content of THF insoluble component (W1) and a content of THF soluble component (W2) is separately determined by a known method such as a TG method and the THF insoluble component (%) is determined by the following formula:

$$\text{THF insoluble component } (\%)=(A-B-W2)/(A-W1-W2)\times100$$

The toner of the present invention is produced by the following method:

a toner composition including at least a binder formed of a modified polyester resin capable of reacting with an active hydrogen and a colorant is dissolved or dispersed in an organic solvent;

the dissolved or dispersed mixture is reacted with a crosslinker and/or an elongation agent in an aqueous medium including a dispersant; and the aqueous medium is removed from the dispersed liquid.

Specific examples of the reactive modified polyester resin capable of reacting with an active hydrogen (RMPE) include a polyester polymer (A) having an isocyanate group. Specific examples of the prepolymer (A) include a polymer formed from a reaction between polyester having an active hydrogen atom formed by polycondensation between polyol (PO) and a polycarboxylic acid, and polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

The modified polyester such as a urea-modified polyester formed from a reaction between the polyester prepolymer having an isocyanate group (A) and an amine (B) is easy to control molecular weight of the high molecular weight component, and preferably used for an oilless low-temperature fixing method (without an release oil applicator for a heating medium for fixation). Particularly, the polyester prepolymer having a urea-modified end can prevent adherence to the heating medium for fixation while maintaining high fluidity and transparency of an unmodified polyester resin in a range of fixing temperature.

The polyester prepolymer for use in the present invention is preferably a polyester having at its end an acid radical or a hydroxyl group including an active hydrogen to which a functional group such as an isocyanate group is introduced. A modified polyester such as a urea-modified polyester can be introduced from the prepolymer. However, in the present invention, the modified polyester used as a toner binder is preferably a urea-modified polyester formed from a reaction between the polyester prepolymer having an isocyanate group (A) and the amine (B) used as a crosslinker and/or an elongation agent. The polyester prepolymer (A) can be formed from a reaction between polyester having an active hydrogen atom formed by polycondensation between polyol (PO) and a polycarboxylic acid, and polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

Amines are used as a crosslinker for the above-mentioned reactive modified polyester resin, and a diisocyanate compound such as diphenylmethane diisocyanate is used as an elongation agent. The amines mentioned in detail later are used as a crosslinker or an elongation agent for the modified polyester capable of reacting with an active hydrogen.

As the polyol (PO), diol (DIO) and polyol having 3 valences or more (TO) can be used, and DIO alone or a mixture of DIO and a small amount of TO is preferably used. Specific examples of DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (PC), dicarboxylic acid (DIC) and polycarboxylic acid having 3 or more valences (TC) can be used. DIC alone, or a mixture of DIC and a small amount of TC are preferably used. Specific examples of DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of TC include aromatic polycarboxylic acids having 9 to 20 carbon atoms such as trimellitic acid and pyromellitic acid. PC can be formed from a reaction between the above-mentioned acids anhydride or lower alkyl ester such as methyl ester, ethyl ester and isopropyl ester.

PO and PC are mixed such that an equivalent ratio ([OH]/[COON]) between a hydroxyl group [OH] and a carboxylic group [COON] is typically from 2/1 to 1/1, preferably from 1.5/1 to 1/1 and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates. The content of the constitutional component of a polyisocyanate in the polyester prepolymer (A) having a polyisocyanate group at its end portion is from 0.5 to 40% by weight, preferably from 1 to 30% by weight and more preferably from 2 to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1–B5) mentioned above are blocked. Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The molecular weight of the urea-modified polyesters can optionally be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

The mixing ratio (i.e., a ratio [NCO]/[NHx]) of the content of the prepolymer (A) having an isocyanate group to the amine (B) is from ½ to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

A polyester resin preferably used in the present invention is a urea-modified polyester (UMPE), and the UMPE may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

A modified polyester such as the UMPE can be produced by a method such as a one-shot method. The weight-average molecular weight of the modified polyester of the UMPE is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the modified polyester of the UMPE is not particularly limited when the aftermentioned unmodified polyester resin (PE) is used in combination. Namely, the weight-average molecular weight of the UMPE resins has priority over the number-average molecular weight thereof. However, when the UMPE is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

In the present invention, not only the modified polyester of the UMPE alone but also the PE can be included as a toner binder with the UMPE. A combination thereof improves low temperature fixability of the resultant toner and glossiness of color images produced thereby, and the combination is more preferably used than using the UMPE alone.

Suitable PE includes polycondensation products of PO and PC similarly to the UMPE and specific examples of the PE are the same as those of the UMPE. The PE preferably has a weight-average particle diameter (Mw) of from 10,000 to 300,000, and more preferably from 14,000 to 200,000. In addition, the PE preferably has a number-average particle diameter of from 1,000 to 10,000, and more preferably from 1,500 to 6,000. In addition, for the UMPE, not only the unmodified polyester but also polyester resins modified by a bonding such as urethane bonding other than a urea bonding, can also be used together. It is preferable that the UMPE at least partially mixes with the PE to improve the low temperature fixability and hot offset resistance of the resultant toner. Therefore, the UMPE preferably has a structure similar to that of the PE. A mixing ratio (UMPE/PE) between the UMPE and PE is from 5/95 to 80/20, preferably from 5/95 to 30/70, more preferably from 5/95 to 25/75, and even more preferably from 7/93 to 20/80. When the UMPE is less than 5%, the hot offset resistance deteriorates, and in addition, it is disadvantageous to have both high temperature preservability and low temperature fixability.

The PE preferably has a hydroxyl value not less than 5 mg KOH/g and an acid value of from 1 to 30 mg KOH/g, and more preferably from 5 to 20 mg KOH/g. Such PE tends to be negatively charged, and the resultant toner has good affinity with a paper and low temperature fixability thereof is improved. However, when the acid value is greater than 30 mg KOH/g, chargeability of the resultant toner deteriorates particularly due to an environmental variation. In a polyaddition reaction, a variation of the acid value causes a crush of particles in a granulation process and it is difficult to control emulsifying.

In the present invention, the toner binder preferably has a glass transition temperature (Tg) of from 40 to 70° C., and preferably from 45 to 60° C. When the glass transition temperature is less than 45° C., the high temperature preservability of the toner deteriorates. When higher than 65° C., the low temperature fixability deteriorates. Due to a combination of the modified polyester such as UMPE and PE, the toner of the present invention has better high temperature preservability than conventional toners including a polyester resin as a binder resin even though the glass transition temperature is low.

A wax for use in the toner of the present invention has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used.

In the present invention, the melting point of the wax is a maximum heat absorption peak measured by a differential scanning calorimeter (DSC).

Specific examples of the release agent include natural waxes such as vegetable waxes, e.g., camauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol-Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1 to 15% by weight, and more preferably from 3 to 10% by weight, based on total weight of the toner.

The colorant for use in the present invention can be used as a master batch pigment when combined with a resin.

Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three roll mill is preferably used for kneading the mixture upon application of high shear stress.

In the present invention, a charge controlling agent is fixed on the surface of the toner particles, for example, by the following method. Toner particles including at least a resin and a colorant are mixed with particles of a release agent in a container using a rotor. In this case, it is preferable that the container does not have a portion projected from the inside surface of the container, and the peripheral velocity of the rotor is preferably from 40 to 150 m/sec.

The toner of the present invention may optionally include a charge controlling agent. Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quatemary ammonium salt), which are manufactured by Hodogaya Chemical Co., Ltd.; COPY CHARGE PSY VP2038 (quaternary ammonium salt), COPY BLUE (triphenylmethane derivative), COPY CHARGE NEG VP2036 and NX 15 VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images. These charge controlling agent and release agent can be kneaded together with a master batch pigment and resin. In addition, the charge controlling agent and release agent can be added when such toner constituents are dissolved or dispersed in an organic solvent.

The thus prepared toner particles including a charge controlling agent on the surface thereof may be mixed with an external additive to assist in improving the fluidity, developing property and charging ability of the toner particles. Suitable external additives include particulate inorganic materials. It is preferable for the particulate inorganic materials to have a primary particle diameter of from 5 nm to 2 pm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition. Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Among these particulate inorganic materials, a combination of a hydrophobic silica and a hydrophobic titanium oxide is preferably used. In particular, when a hydrophobic silica and a hydrophobic titanium oxide each having an average particle diameter not greater than 50 nm are used as an external additive, the electrostatic force and van der Waals' force between the external additive and the toner particles are improved, and thereby the resultant toner composition has a proper charge quantity. In addition, even when the toner composition is agitated in a developing device, the external additive is hardly released from the toner particles, and thereby image defects such as white spots and image omissions are hardly produced. Further, the quantity of particles of the toner composition remaining on image bearing members can be reduced.

When particulate titanium oxides are used as an external additive, the resultant toner composition can stably produce toner images having a proper image density even when environmental conditions are changed. However, the charge rising properties of the resultant toner tend to deteriorate. Therefore the addition quantity of a particulate titanium oxide is preferably smaller than that of a particulate silica, and in addition the total addition amount thereof is preferably from 0.3 to 1.5% by weight based on weight of the toner particles not to deteriorate the charge rising properties and to stably produce good images without toner cloud (i.e., toner scattering).

The UMPE for use as the binder resin of the toner of the 5 present invention is prepared, for example, by the following method.

PO and PC are heated to a temperature of from 150 to 280° C. in the presence of a known catalyst such as tetrabutoxytitanate and dibutyltin oxide. Then water generated is removed, under a reduced pressure if desired, to prepare a polyester resin having a hydroxyl group. Then the polyester resin is reacted with a PIC at a temperature of from 40 to 140° C. to prepare a polyester prepolymer (A) having an isocyanate group. Further, the polyester prepolymer (A) is reacted with an amine (B) at a temperature of from 0 to 140° C., to prepare the UMPE. The UMPE preferably has a number-average particle diameter of from 1,000 to 10,000, and more preferably from 1,500 to 6,000. When the PIC, and A and B are reacted, a solvent can be used if desired. Suitable solvents include solvents which do not react with the PIC. Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

When a PE, which does not have a urea bonding, is used in combination with the UMPE, the PE is prepared by a method similar to that used for preparing the polyester reins having a hydroxyl group, and the PE is added to the solution of the UMPE after the reaction of forming the UMPE has completed.

The toner of the present invention is produced by the following method, but the method is not limited thereto.

The aqueous medium for use in the present invention include water alone and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

In the present invention, the reactive modified polyester such as a polyester prepolymer having an isocyanate group (A) is reacted with the amines (B) in the aqueous medium to form the UMPE.

In order to prepare a dispersion in which a modified polyester such as UMPE or a reactive modified polyester such as a prepolymer (A) is stably dispersion in an aqueous medium, a method, in which toner constituents including a modified polyester such as UMPE or a reactive modified polyester such as a prepolymer (A) are added into an aqueous medium and then dispersed upon application of shear stress, is preferably used. A prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method in which particles, which are previously formed without a colorant, are dyed by a known dying method can also be used.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 $\mu$m to 20 $\mu$m can be easily prepared. At this point, the particle diameter (2 to 20 $\mu$m) means a particle diameter of particles including a liquid). When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, a UMPE or a prepolymer (A) can be easily dispersed because the dispersion has a low viscosity.

A content of the aqueous medium to 100 parts by weight of the toner including a UMPE or a prepolymer (A) is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase. A dispersant can be preferably used when a dispersion is prepared, to prepare a dispersion including particles having a sharp particle diameter distribution and to prepare a stable dispersion.

Various dispersants are used to emulsify and disperse an oil phase for a liquid including water in which the toner constituents are dispersed. Such dispersants include a surfactant, an inorganic fine-particle dispersant, a polymer fine-particle dispersant, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di)octylaminoethyle)glycine, and N-alkyl-N,N-dimethylammonium betaine.

A surfactant having a fluoroalkyl group can prepare a dispersion having good dispersibility can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy)-1-alkyl(C3–C4) sulfonate, sodium 3-lomega-fluoroalkanoyl(C6–C8)-N-ethylamino)-1-propanesulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10) sulfoneamidepropyltrimethylammonium salts, salts of perfluoroalkyl(C6–C10)-N-ethylsulfonylglycin, monoperfluoroalkyl(C6–C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by DainipponInk and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6–C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite which are hardly insoluble in water can also be used.

In addition, particulate polymers can also be used as a dispersant as well as inorganic dispersants such as calcium phosphate, sodium carbonate and sodium sulfate. Specific examples of the particulate polymers include particulate polymethyl methacrylate having a particle diameter of from 1 μm and 3 μm, particulate polystyrene having a particle diameter of from 0.5 μm and 2 μm, particulate styrene-acrylonitrile copolymers having a particle diameter of 1 um, PB-200H (from Kao Corp.), SGP (Soken Chemical & Engineering Co., Ltd.), TECHNOPOLYMER SB (Sekisui Plastics Co., Ltd.), SPG-3G (Soken Chemical & Engineering Co., Ltd.), and MICROPEARL (Sekisui Fine Chemical Co., Ltd.).

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The prepared emulsified dispersion (reactant) is gradually heated while stirred in a laminar flow, and an organic solvent is removed from the dispersion after stirred strongly when the dispersion has a specific temperature to from a toner particle having a shape of spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle.

Further, in order to decrease viscosity of a dispersion medium including the toner constituents, a solvent which can dissolve the UMPE or prepolymer (A) can be used because the resultant particles have a sharp particle diameter distribution. The solvent is preferably volatile and has a boiling point lower than 100° C. because of easily removed from the dispersion after the particles are formed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the modified polyester (prepolymer) with amine.

A shape of the toner, i.e., SF-1 and SF-2 can be properly controlled by the solvent removal conditions. In order to control a diameter of a concavity of a toner, an oil solid content of a liquid emulsified and dispersed in an aqueous medium has to be 5 to 50%, a solvent removal temperature has to be from 10 to 50° C., and further a solvent removal time is not longer than 30 min. This is because the solvent included in the oil content evaporates in a short time and the comparatively hard and elastic oil is disproportionately constricted at a low temperature. When the oil solid content is greater than 50%, possibility of occurrence of volume constriction decreases because an amount of the evaporative solvent is small. When less than 5%, the productivity deteriorates. The longer the time, the less occurrence of the volume constriction, and a toner particle is ensphered small. However, the above-mentioned conditions are not absolute conditions, and the temperature and time have to be balanced.

The elongation and/or crosslinking reaction time depends on reactivity of an isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used. The amines (B) can be used as 20 the elongation agent and/or crosslinker.

In the present invention, a solvent is preferably removed from the dispersion liquid after the elongation and/or crosslinking reaction at 10 to 50° C. after it is strongly stirred in a shape controlling process using a stirring tank without a baffle inside and a protrusion on an inside surface thereof. This stirring process before removing the solvent can control a shape of toner SF-1. The emulsified liquid is strongly stirred in the stirring tank without baffle and protrusion at 30 to 50° C. to form a spindle-shaped toner particle and the solvent is removed at 10 to 50° C. This is not an absolute condition and the condition has to be properly controlled. However, it is supposed that the shape of the toner particle change to a spindle shape from a sphere because ethyl acetate included in the liquid decreases viscosity of the emulsified liquid and a stronger stirring force is applied to the toner particle.

On the other hand, a ratio (Dv/Dn) between a volume-average particle diameter (Dv) and a number-average particle diameter (Dn) of the toner can be fixed by controlling a water layer viscosity, an oil layer viscosity, properties of resin particles, addition quantity thereof, etc. In addition, Dv and Dn can be fixed by controlling the properties of resin particles, addition quantity thereof, etc.

The toner of the present invention can be used for a two-component developer in which the toner is mixed with a magnetic carrier. A content of the toner is preferably from 1 to 10 parts by weight per 100 parts by weight of the carrier. Suitable carriers for use in the two component developer include known carrier materials such as iron powders, ferrite powders, magnetite powders, magnetic resin carriers, which have a particle diameter of from about 20 to about 200 $\mu$m. A surface of the carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidenefluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 $\mu$m. When the particle diameter is too large, it is hard to control the resistance of the resultant toner.

The toner of the present invention can also be used as a one-component magnetic developer or a one-component non-magnetic developer.

The image forming method of the present invention is a method of using the toner of the present invention in a conventional image forming method of using a toner. The image forming apparatus of the present invention is an image forming apparatus using the toner of the present invention in a conventional image forming apparatus using a toner.

FIG. 1 is a schematic view illustrating an embodiment of the image forming apparatus of the present invention. In the FIGURE, numeral 1 is a photoreceptor drum as a latent image bearer and rotates in a direction indicated by an arrow. A charger 2 is located around the photoreceptor and a laser beam 3 having an image information of an original image is irradiated to the photoreceptor. Further, an image developer 4, a paper feeder 7, a transferor 5, a cleaner 6 and a discharging lamp 9 are located around the photoreceptor 1. The image developer further includes developing rollers 41 and 42, a paddle-shaped stirrer 43, stirrer 44, a doctor blade 45, a toner feeder 46 and a feeding roller 47. The cleaner 6 includes a cleaning brush 61 and a cleaning blade 62. In addition, numerals 81 and 82 located above and below the image developer 4 are guide rails to put on and take off the image developer.

A longevity of the cleaning blade 61 of the cleaner can be detected. The cleaning blade 61 is constantly contacted to the photoreceptor and abraded in accordance with a rotation thereof. When the cleaning blade is abraded, capability of removing a residual toner on the photoreceptor deteriorates, resulting in deterioration of the resultant image quality. In addition, even if not abraded, when the toner has almost a spherical form, deterioration of cleanability tends to occur because the toner passes through the blade although transferability is improved. However, when the toner of the present invention is used, the cleanability improves.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

In a reaction container with a condenser, a stirrer and a nitrogen introducing tube, 690 parts of an adduct of bisphenol A with 2 moles of ethyleneoxide and 256 parts of terephthalic acid were mixed. The mixture was reacted for 8 hrs at 230° C. under a normal pressure. Then the reaction was further performed for 5 hrs under a reduced pressure of from 10 to 15 mmHg. After the reaction product was cooled to 160° C., 18 parts of phthalic anhydride were added thereto to further perform a reaction for 2 hrs to prepare an unmodified polyester (a).

Preparation for a Prepolymer

In a reaction container with a condenser, a stirrer and a nitrogen introducing tube, 800 parts of an adduct of bisphenol A with 2 moles of ethyleneoxide, 180 parts of isophthalic acid, 60 parts of terephthalic acid and 2 parts of dibutyltinoxide were mixed. The mixture was reacted for 8 hrs at 230° C. under a normal pressure. Then the reaction was further performed for 5 hrs under a reduced pressure of from 10 to 15 mmHg. After the reaction product was cooled to 160° C., 32 parts of phthalic anhydride were added thereto to further perform a reaction for 2 hrs. Then, the reaction production was cooled to 80° C. and mixed with 170 parts of isophorondiisocyanate in ethyl acetate and reacted for 2 hrs to prepare a prepolymer including an isocyanate group (1).

Preparation for a Ketimine Compound

In a reaction container with a stirring stick and a thermometer, 30 parts of isophorondiamine and 70 parts of methyl ethyl ketone are mixed and reacted at 50° C. for 5 hrs to prepare a ketimine compound (1).

Preparation for a Toner

In a beaker, 14.3 parts of the above-mentioned prepolymer (1), 55 parts of the polyester (a) and 78.6 parts of ethyl acetate were mixed and stirred to be dissolved. 10 parts of rice wax (having a melting point of 83° C.) as a release agent and 4 parts of copper phthalocyanine blue pigment were mixed with the mixture and stirred for 5 min by a TK-type homomixer at a speed of 12,000 rpm at 60° C., and then dispersed by a beads mill for 30 min at 20° C. to prepare a toner constituents liquid (1).

Next, 306 parts of deionized water, 260 parts of a 10 slurry of tricalcium phosphate and 0.2 parts of sodium dodecylbenzenesulfonate were mixed and uniformly dissolved in a beaker. Then, the above-mentioned toner constituents liquid (1) and 2.7 parts of the ketimine compound (1) were added into the mixture while stirred with a TK-type homomixer at a speed of 12,000 rpm to perform a urea reaction.

When a particle diameter is large, the mixture is further stirred at a higher speed of 14,000 rpm while observing the ketimine compound (1) and a ketimine compound (1) distribution with an optical microscope. When the diameter is small, the speed is changed to 10,000 rpm. Next, 500 g of the mixture was put into a round-bottom flask with a stirring stick and a thermometer and heated up to 45° C., and stirred at a high speed of 200 to 400 rpm for 2 hrs to prepare mother toner particles having a shape of spindle. When the shape of spindle is unsatisfactory, stirring time is prolonged. Then, a solvent was removed from the mother toner particles under a low pressure for 1.0 hr, and the mother toner particles were filtered, washed, dried and classified with a wind force.

Next, 100 parts of the mother toner particles and 0.25 parts of a charge controlling agent (BONTRON E-84 from Orient Chemical Industries Co., Ltd.) were mixed by a Q-form mixer 20 manufactured by Mitsui Mining Co., Ltd., wherein a rotation speed of turbine blade was 50 m/sec and 5 cycles of a mixing operation for 2 minutes and a pause for 1 minute were performed.

Further, 0.5 parts of a hydrophobic silica (H2000 manufactured by Clariant Japan K. K.) were added to the mixture, which was mixed in the Q-form mixer, wherein a rotation speed of turbine blade was 15 m/sec and 5 cycles of a mixing operation for 30 seconds and a pause for 1 minute were performed to form a cyan toner. Then, 0.5 parts of a hydrophobic silica and 0.5 parts of hydrophobized titanium oxide were mixed with the cyan toner by a Henshel mixer to prepare a toner (1) of the present invention.

Example 2

Preparation for a Prepolymer

In a reaction container with a condenser, a stirrer and a nitrogen introducing tube, 856 parts of an adduct of bisphenol A with 2 moles of ethyleneoxide, 200 parts of isophthalic acid, 20 parts of terephthalic acid and 4 parts of dibutyltinoxide were mixed. The mixture was reacted for 6 hrs at 250° C. under a normal pressure. Then the reaction was further performed for 5 hrs under a reduced pressure of from 50 to 100 mmHg. After the reaction product was cooled to 160° C., 18 parts of phthalic anhydride were added thereto to further perform a reaction for 2 hrs. Then, the reaction production was cooled to 80° C. and mixed with 170 parts of isophorondiisocyanate in ethyl acetate and reacted for 2 hrs to prepare a prepolymer including an isocyanate group (2).

Preparation for a Toner

In a beaker, 15.4 parts of the above-mentioned prepolymer (2), 50 parts of the polyester (a) and 95.2 parts of ethyl acetate were mixed and stirred to be dissolved. 20 parts of camauba wax (having a molecular weight of 1,800, an acid value of 2.5 and a penetration of 1.5 mm/40° C.) and 3 parts of copper phthalocyanine blue pigment were mixed with the mixture and stirred for 5 min by a TK-type homomixer at a speed of 10,000 rpm at 85° C., and then dispersed by a beads mill for 30 min at 20° C. to prepare a toner constituents liquid (2).

Next, the procedures of preparation for a toner in Example 1 were repeated except for using the above-mentioned toner constituents liquid (2) and a charge controlling agent (BONTRON E-89 from Orient Chemical Industries Co., Ltd.) to prepare a toner (2).

Example 3

Preparation for a Prepolymer

In a reaction container with a condenser, a stirrer and a nitrogen introducing tube, 100 parts of an adduct of bisphenol A with 2 moles of ethyleneoxide, 130 parts of isophthalic acid and 2 parts of dibutyltinoxide were mixed. The mixture was reacted for 8 hrs at 230° C. under a normal pressure. Then, after the reaction was further performed for 5 hrs under a reduced pressure of from 10 to 15 mmHg, the reaction product was cooled to 160° C. to prepare a prepolymer including a hydroxyl group (3).

Preparation for a Dead Polymer

In a reaction container with a condenser, a stirrer and a nitrogen introducing tube, 589 parts of an adduct of bisphenol A with 2 moles of ethyleneoxide and 46 parts of dimethylterephthalate ester were mixed and the mixture was reacted for 6 hrs at 230° C. under a normal pressure. Then, the reaction was further performed for 5 hrs under a reduced pressure of from 10 to 15 mmHg to prepare a dead polymer (I).

Preparation for a Toner

In a beaker, 15.3 parts of the above-mentioned prepolymer (3), 63.6 parts of the dead polymer (I), 40 parts of toluene and 40 parts of ethylene acetate were mixed and stirred to be dissolved. 10 parts of rice wax (having a melting point of 83° C.) as a release agent and 4 parts of copper phthalocyanine blue pigment were mixed with the mixture and stirred for 5 min by a TK-type homomixer at a speed of 12,000 rpm at 60° C., and then dispersed by a beads mill for 30 min at 25° C. Finally, 1.1 parts of diphenylmethanediisocyanate as an elongation agent was added and dissolved in the mixture to prepare a toner constituents liquid (3).

Next, 406 parts of deionized water, 294 parts of a 10% slurry of tricalcium phosphate and 0.2 parts of sodium dodecylbenzenesulfonate were added were mixed and uniformly dissolved in a beaker. Then, the mixture was heated up to 60° C. and the above-mentioned toner constituents liquid (3) was mixed in the mixture while stirred with a TK-type homomixer at a speed of 12,000 rpm for 10 min. Next, 500 g of the mixture was put into a round-bottom flask with a stirring stick and a thermometer and heated up to 50° C. for 30 min to perform a urethane reaction, and stirred at a speed of 300 rpm for 25 min to prepare mother toner particles. Then, a solvent was removed therefrom, and the mother toner particles were filtered, washed, dried and classified with a wind force to prepare mother toner particles having a shape of spindle. Next, the procedures of preparation for a toner in Example 1 were repeated to prepare a toner (3).

Example 4

Preparation for a Prepolymer

In a reaction container with a condenser, a stirrer and a nitrogen introducing tube, 755 parts of an adduct of bisphenol A with 2 moles of ethyleneoxide, 195 parts of isophthalic acid, 15 parts of terephthalic acid and 4 parts of dibutyltinoxide were mixed. The mixture was reacted for 8 hrs at 220° C. under a normal pressure. Then the reaction was further performed for 5 hrs under a reduced pressure of from 50 to 100 mmHg. After the reaction product was cooled to 160° C., 10 parts of phthalic anhydride were added thereto to further perform a reaction for 2 hrs. Then, the reaction production was cooled to 80° C. and mixed with 170 parts of isophorondiisocyanate in ethyl acetate and reacted for 2 hrs to prepare a prepolymer including an isocyanate group (4).

Preparation for a Toner

In a beaker, 15.4 parts of the above-mentioned prepolymer (4), 50 parts of the polyester (a) and 95.2 parts of ethyl acetate were mixed and stirred to be dissolved. 20 parts of carnauba wax (having a molecular weight of 1,800, an acid value of 2.5 and a penetration of 1.5 mm/40° C.) and 3 parts of copper phthalocyanine blue pigment were mixed with the mixture and uniformly dispersed by a TK-type homomixer at a speed of 12,000 rpm at 85° C., and then dispersed by a beads mill for 50 min at 15° C. to prepare a toner constituents liquid (4).

Next, 465 parts of deionized water, 245 parts of a 10% slurry of tricalcium phosphate and 0.4 parts of sodium dodecylbenzenesulfonate were mixed and uniformly dissolved in a beaker. Then, after the mixture was heated up to 40° C. and the above-mentioned toner constituents liquid (4) was added into the mixture while stirred with a TK-type homomixer at a speed of 12,000 rpm for 10 min, 2.7 parts of the ketimine compound (1) were added into the mixture to perform an elongation reaction. Next, the mixture was put into a round-bottom flask with a stirring stick and a thermometer, and stirred at a speed of 300 rpm for 2 hrs at 40° C. to prepare mother toner particles having a shape of spindle. Then, a solvent was removed from the mother toner particles for 1.0 hr at 40° C., and the mother toner particles were filtered, washed, dried and classified with a wind force. The emulsified dispersion liquid had a concentration of 13%. Next, the procedures of preparation for a toner in Example 1 were repeated to prepare a toner (4).

Comparative Example 1

Preparation for a Toner Binder 395 parts of an adduct of bisphenol A with 2 moles of ethyleneoxide, 166 parts of isophthalic acid and 2 parts of dibutyltinoxide were mixed and reacted to prepare a comparative toner binder 1.

Preparation for a Toner

In a beaker, 100 parts of the above-mentioned comparative toner binder 1, 180 parts of ethyl acetate 4 parts of copper phthalocyanine blue pigment, and 10% hydroxyapatite liquid (Supertite 10 from Nippon Chemical Industrial Co., Ltd.) and sodium dodecylbenzenesulfonate as a dispersant were mixed and stirred by a TK-type homomixer at 10,000 rpm to be uniformly dissolved and dispersed. Next, the procedures of preparation for a toner in Example 1 were repeated to prepare mother toner particles of Comparative Example 1 except that a solvent was slowly removed for 8 hrs. 100 parts of the mother toner particles, 0.3 parts of hydrophobic silica and 0.3 parts of hydrophobized titanium oxide were mixed with a Henshel mixer to prepare a toner of Comparative Example 1.

Comparative Example 2

In a reaction container with a condenser, a stirrer and a nitrogen introducing tube, 343 parts of an adduct of bisphenol A with 2 moles of ethyleneoxide, 166 parts of isophthalic acid and 2 parts of dibutyltinoxide were mixed. The mixture was reacted for 8 hrs at 230° C. under a normal pressure. Then, after the reaction was further performed for 5 hrs under a reduced pressure of from 10 to 15 mmHg, the reaction product was cooled to 80° C. 14 parts of toluenediisocyanate were added in the mixture and reacted for 5 hrs at 110° C. and a solvent was removed therefrom to prepare urethane-modified polyester. 363 parts of an adduct of bisphenol A with 2 moles of ethyleneoxide and 166 parts of isophthalic acid were mixed and reacted to prepare unmodified polyester. 350 parts of the urethane-modified polyester and 650 parts of the unmodified polyester were dissolved and mixed in toluene, and a solvent was removed to prepare a comparative toner binder 2.

Preparation for a Toner 100 parts of the comparative toner binder 82), 2 parts of chrome salicylate complex (E-81 from Orient Chemical Industries Co., Ltd.) and 4 parts of copper phthalocyanine blue pigment were preliminarily mixed with a Henshel mixer and kneaded with a continuous kneader. Next, the mixture was pulverized with a jet pulverizer and classified with an airflow classifier to prepare mother toner particles. 100 parts of the mother toner particles, 0.3 parts of hydrophobic silica and 0.3 parts of hydrophobized titanium oxide were mixed with a Henshel mixer to prepare a toner of Comparative Example 2.

Comparative Example 3

The following components were mixed for 10 hours using a ball mill.

| | |
|---|---|
| Polyester resin (a bisphenol type resin manufactured by Kao Corp. and having a number-average molecular weight Mn of 6,000, a weight-average molecular weight Mw of 70,000 and a glass transition temperature Tg of 64° C.) | 90 |
| Carbon black (BP1300 from Cabot Corp.) | 10 |
| Rice wax (melting point of 82° C.) | 10 |
| Mixture solvent of diethyl ether and dichloromethane at a weight ratio of 1/1 | 300 |

The thus prepared dispersion was added to 400 g of a 2% aqueous solution of gum arabic, and the mixture was stirred with a homomixer for 3 min to prepare a dispersion. Then the dispersion was added to 2,000 parts of pure water. The mixture was heated to 80° C. in a water bath and stirred for 4 hours using a stirrer. Thus, irregular particles having an average particle diameter of 6.0 μm and having a recessed portion. The suspension was heated to 98° C. and maintained for 1 hr at the temperature to prepare mother toner particles.

The procedure for preparation of a in Example 1 was repeated except that mother toner particles were replaced with the mother toner particles prepared above to prepare a toner of Comparative Example 3.

Example 5

The following materials were sufficiently stirred and mixed in a Henshel mixer.

| | |
|---|---|
| Polyester resin (having a weight-average molecular weight of 7,000, a melting point of 110° C. and an acid value of 25 mgKOH/g) | 90 |
| Polyester resin (having a weight-average molecular weight of 80,000, a melting point of 143° C. and an acid value of 20 mgKOH/g) | 10 |
| Carnauba wax (having a melting point of 85° C. and a volume-average particle diameter or 590 μm) | 5 |
| Carbon black (# 44 from Mitsubishi Kasei Corp.) | 8 |
| Zirconium salt of 3,5-di-butylsalicylate | 1 |

The mixture was melted upon application of heat at from 100 to 110° C. for about 30 min and cooled until the mixture had a room temperature. The mixture was pulverized by a jet mill and classified with a wind-force classifier to prepare a toner. (An amount of the toner having a desired particle diameter distribution was 11% of a total amount of the materials.) After 1.0 part of silica (R974 from Nippon Aerosil Co.) and 0.5 parts of titania (T805 from Nippon Aerosil Co.) are included in 100 parts of the toner and the mixture was stirred and mixed by a Henshel mixer, particles having a large particle diameter are removed with a mesh.

Comparative Example 4

Mixing Process

The following materials were mixed by a Bumbury's mixer (from Kobe Steel, Ltd.) to prepare a dispersion.

| | |
|---|---|
| Styrene-n-butylacrylate resin (having a copolymerization ratio of 55:45, a Mn of 3,100 and a Mw of 8,200, and formed by a liquid solution polymerization) | 90 |
| Carbon black (from Cabot Corp.) | 5 |
| Polypropylene (having a molecular weight of about 8,000 from Mitsui Petrochemical Industries, Ltd.) | 5 |

100 parts of the dispersion was included in 400 parts of ethyl acetate, and the mixture was stirred for 2 hrs at 20 °C. to prepare 500 parts of toner constituents liquid including the dissolved styrene-n-butylacrylate resin.

Dispersion and Suspension Process

The following materials were stirred in a supersonic dispersant to prepare an aqueous medium.

| | |
|---|---|
| Resin fine particles (A copolymer of styrene-methacrylic acid-butylacrylate and a sodium salt of sulfate of an adduct of meth-acrylic acid with ethylene oxide having a particle diameter of 0.10 μm and a Tg of 57° C.) | 22 |
| Carboxymethylcellulose (having an etherification of 0.75 and an average polymerization of 850 from Dai-ichi Kogyo Seiyaku Co., Ltd.) | 0.03 |
| Ion-exchanged water | 99.97 |

100 g of the above-mentioned toner constituents liquid was slowly included in 220 g of the aqueous medium while stirred with a homogenizer (from IKA) at 10,000 rpm for 2 min to prepare 320 g of a dispersed suspension liquid.

Solvent Removal Process

The dispersed suspension liquid was heated to have a temperature of 50° C. while stirred. The temperature was kept at 50° C. for 3 hrs and the liquid was cooled to have a room temperature.

Wash and Dehydration Process 40 g of a decanormal hydrochloric acid was included in 200 g of the liquid prepared in the above-mentioned solvent removal process, and the liquid was washed for 4 times by a suction filtration using ion-exchanged water.

Dry and Sieving Process

A fine particle cake prepared in the dehydration process was dried by a vacuum dryer, and sieved with a mesh having an opening of 45 μm.

External Additive Mixing Process

The procedure of including an external additive in Example 1 was repeated.

Aspects of the toners prepared in Examples 1 to 4 and Comparative Examples 1 to 3 are shown in Table 1.

In addition, performance evaluation results of the toners prepared in Examples 1 to 5 and Comparative Examples 1 to 4 are 15 shown in Table 2.

TABLE 1

| Ex. | Mp | Mn | Mw less than 2500 (%) | THF-in-soluble (%) | Acid value | Tg (° C.) |
|---|---|---|---|---|---|---|
| 1 | 4,000 | 4,000 | 5 | 8 | 6 | 55 |
| 2 | 5,600 | 3,400 | 5 | 4 | 6 | 51 |
| 3 | 7,500 | 4,500 | 4 | 2 | 15 | 59 |
| 4 | 6,500 | 3,500 | 3 | 6 | 14 | 49 |
| Com. Ex. 1 | 6,000 | 4,000 | 6 | 0 | 15 | 61 |
| Com. Ex. 2 | 3,800 | 3,200 | 4 | 0 | 7 | 59 |
| Com. Ex. 3 | 4,000 | 6,000 | 3 | 0 | 12 | 60 |

Mp: Main peak molecular weight of THF-soluble resin
Mn: Number-average molecular weight of THF-soluble resin

TABLE 2

| | SF-1 | SF-2 | Dv/Dn | VAPD (μm) | LFT (° C.) | HOT (° C.) | CS | HTP | PF |
|---|---|---|---|---|---|---|---|---|---|
| Ex. 1 | 155 | 115 | 1.15 | 6.2 | 150 | 220 | ○ | Δ | ○ |
| Ex. 2 | 160 | 105 | 1.16 | 5.5 | 150 | 220 | ○ | ○ | ○ |
| Ex. 3 | 171 | 120 | 1.14 | 4.9 | 160 | 230 | ○ | ○ | Δ |
| Ex. 4 | 165 | 115 | 1.10 | 6.2 | 140 | 220 | ○ | ○ | ○ |
| Ex. 5 | 160 | 170 | 1.20 | 6.3 | 135 | 230 | | ○ | |
| Com. Ex. 1 | 160 | 145 | 1.38 | 7.0 | 155 | | ○ | ○ | Δ |
| Com. Ex. 2 | 160 | 150 | 1.45 | 7.5 | 155 | | x | ○ | x |
| Com. Ex. 3 | 140 | 120 | 1.35 | 6.0 | 160 | 180 | ○ | ○ | x |
| Com. Ex. 4 | 141 | 123 | 1.06 | 7.1 | 175 | 220 | | ○ | |

VAPD: Volume-average particle diameter
LFT: Lowest fixable temperature
HOT: Hot offset resistance
CS: Charge stability
HTP: high temperature preservability
PF: Powder fluidity Evaluation Methods 1. Glass Transition Temperature (Tg)

In the present invention, the glass transition temperature was measured by a TG-DSC system TAS-100 manufactured by Rigaku Corp. The procedure for measurements of glass transition temperature is as follows:

(1) a sample of about 10 mg is contained in an aluminum container, and the container is set on a holder unit;

(2) the holder unit is set in an electrical furnace, and the sample is heated from room temperature to 150° C. at a temperature rising speed of 10° C./min;

(3) after the sample is allowed to settle at 150° C. for 10 minutes, the sample is cooled to room temperature;

(4) after the sample is allowed to settle at room temperature for 10 minutes; and (5) the sample is again heated under a nitrogen atmosphere from room temperature to 150° C. at a temperature rising speed of 10° C./min to perform a DSC measurement.

The glass transition temperature of the sample was determined using an analysis system of the TAS-100 system. Namely, the glass transition temperature is defined as the contact point between the tangent line of the endothermic curve at the temperatures near the glass transition temperature and the base line of the DSC curve.

2. Acid Value and Hydroxyl Value

The acid value and hydroxyl value were measured by methods based on JIS K0070. When the sample was not dissolved, dioxane or tetrahydrofuran was used as the solvent.

3. Powder (i.e., Toner) Fluidity

The bulk density of a toner composition was measured using a powder tester manufactured by Hosokawa Micron Corp. The larger the bulk density of a toner, the better fluidity the toner has. Fluidity is evaluated while classified into the following 4 grades:

◎: not less than 0.35

○: not less than 0.30 and less than 0.35

Δ: not less than 0.25 and less than 0.30

: less than 0.25

4. High Temperature Preservability

A toner sample was preserved at 50° C. for 8 hours. Then the toner sample was sieved for 2 min using a screen of 42 meshes to determine the weight ratio of the residue on the screen. High temperature preservability is evaluated while classified into the following four grades:

◎: less than 10%

○: not less than 10% and less than 20%

Δ: not less than 20% and less than 30%

: not less than 30%

5. Lowest Fixable Temperature

Toner images were formed on a copy paper, TYPE 6200 from Ricoh Co., Ltd., using a copier, imagio NE0450, which is manufactured by Ricoh Co., Ltd. and which uses a modified fixing unit having a fixing roller made of Fe cylinder having a thickness of 0.34 mm. A surface pressure was fixed at 1.0×105 Pa. The images were rubbed with a pad to determine the residual ratio of the image density of the images. The low temperature fixability of a toner is defined as the minimum value of the fixable temperature range of the toner images in which the toner images have a residual ratio of the image density not less than 70%.

6. Hot Offset Temperature

The above-prepared toner images were visually observed to determine whether there is hot offset image in the toner images. The hot offset temperature of a toner is defined as the minimum value of the fixing temperatures of the toner images 20 having a hot offset image.

7. Charge Stability

Charge quantities of a toner were measured by a blow-off method under low temperature/low humidity (10° C. 30% RH) and high temperature/high humidity (30° C. 90% RH) conditions to determine the charge variation of the toner. An iron powder coated with a silicone resin was used as the carrier. The less the variation, the better.

◎: variation is small and stable

○: variation is slight large

Δ: variation is large

: unusable

8. Image Qualities

Each of the toners of Examples 1 to 4 and Comparative Examples 1 to 3 was set in a color copier, IMAGIO COLOR 4000, and images were produced. The image qualities of the images and transferability of the toner were visually evaluated. In addition, 1 dot independent images (1,200 dpi) were produced to evaluate micro dot reproducibility. This was to evaluate dot reproducibility of a latent image on a photoreceptor, and the images were observed with a microscope to classify them into five grades (5 is the maximum score). The results are shown in Table 3.

TABLE 3

| | Micro dot image reproducibility | Transfer-ability (%) | Image qualities & Cleanability |
|---|---|---|---|
| Ex. 1 | 4 | 96 | Good |
| Ex. 2 | 3 | 95 | Good |
| Ex. 3 | 5 | 90 | Good |
| Ex. 4 | 5 | 94 | Good |
| Ex. 5 | 3 | 90 | Good |
| Com. Ex. 1 | 2 | 92 | — |
| Com. Ex. 2 | 1 | 92 | Image density decreased after 30,000 images were produced because the charge quantity of the toner decreased. |
| Com. Ex. 3 | 3 | 100 | A failure of cleaning (a stripe) occurred after 10,000 images were produced |
| Com. Ex. 4 | 5 | 98 | Evaluation could not be performed due to a failure in fixing an image. |

This document claims priority and contains subject matter related to Japanese Patent Applications Nos. 2001-338425 and 2002-160541, filed on Nov. 2, 2001 and May 31, 2002 respectively, incorporated herein by reference.

Having now fully described the invention, it will be apparent to one of ordinary skill in the art that many changes and modifications can be made thereto without departing from the spirit and scope of the invention as set forth therein.

What is claimed as new and is intended to be secured by Letters Patent is:

1. A toner comprising:

a binder resin which is at least a resin selected from the group consisting of modified polyester resins and unmodified polyester resins; and a colorant;

the product toner having a volume-average particle diameter (Dv) to a number-average particle diameter (Dn) ratio (Dv/Dn) ranging from 1.00 to 1.30, and the toner having a shape factor SF-1 ranging from 140 to 200.

2. The toner of claim 1, wherein the ratio (Dv/Dn) ranges from 1.00 to 1.20.

3. The toner of claim 1, wherein the shape factor SF-1 ranges from 150 to 180.

4. The toner of claim 1, wherein the toner has the shape of a spindle.

5. The toner of claim 1, wherein the volume-average particle diameter (Dv) ranges from 3.0 to 7.0 $\mu$m.

6. The toner of claim 1, wherein the toner further comprises particles having a volume-average particle diameter not greater than 3.0 $\mu$m in an amount ranging from 1 to 10%.

7. The toner of claim 1, wherein the toner is prepared by a method comprising:

dispersing a modified polyester resin which is reactive with active hydrogen, a colorant and a release agent in an aqueous medium with a dispersant to form a first dispersion liquid;

reacting the modified polyester resin in the first dispersion liquid with a member selected from the group consisting of crosslinking agents and elongation agents to form a second dispersion liquid including a reaction product; and removing the aqueous medium from the second dispersion liquid.

8. The toner of claim 7, wherein the aqueous medium comprises an organic solvent.

9. The toner of claim 8, wherein the organic solvent is removed from the second dispersion liquid at a temperature ranging from 10 to 50° C. after the second dispersion liquid is stirred in a stirring tank without a baffle and a protrusion.

10. The toner of claim 1, wherein the binder resin comprises a tetrahydrofuran soluble resin having a molecular weight distribution in which a main peak is present between 2,500 and 10,000 molecular weight units, and a tetrahydrofuran insoluble resin in an amount ranging from 1 to 25% by weight based on total weight of the toner.

11. The toner of claim 10, wherein the toner comprises the tetrahydrofuran soluble resin having a molecular weight less than 2,500 in an amount of 0.1 to 5.0% by weight based on total weight of the toner.

12. The toner of claim 1, wherein the modified polyester resin has a glass transition point ranging from 40 to 70° C. and an acid value of from 1 to 30 mg KOH/g.

13. A two-component developer comprising a toner and a carrier, wherein the toner is the toner according to claim 1.

14. An image forming method comprising:

charging an electrostatic latent image bearer;

irradiating the electrostatic latent image bearer with light to form an electrostatic latent image thereon;

developing the electrostatic latent image with the toner of claim 1 to form a toner image on the electrostatic latent image bearer;

transferring the toner image onto a receiving material;

fixing the toner image on the receiving material; and cleaning a surface of the electrostatic latent image bearer with a blade to remove toner residue thereon.

15. An image forming apparatus comprising:

a charger configured to charge an electrostatic latent image bearer;

an irradiator configured to irradiate the electrostatic latent image bearer with light to form an electrostatic latent image thereon;

an image developer configured to develop the electrostatic latent image with the toner of claim 1 to form a toner image on the electrostatic latent image bearer;

a transferor configured to transfer the toner image onto a receiving material;

a fixer configured to fix the toner image on the receiving material; and a cleaner configured to clean the electrostatic latent image bearer with a blade to remove a residue of the toner thereon.

16. The image forming apparatus of claim 15, wherein the fixer fixes the toner image on the receiving material by passing the toner image through two rollers upon application of heat and a surface pressure not greater than $1.5\times10^5$ Pa.

* * * * *